US008698414B2

(12) United States Patent
Bowling et al.

(10) Patent No.: US 8,698,414 B2
(45) Date of Patent: Apr. 15, 2014

(54) HIGH RESOLUTION PULSE WIDTH MODULATION (PWM) FREQUENCY CONTROL USING A TUNABLE OSCILLATOR

(75) Inventors: Stephen Bowling, Chandler, AZ (US); James Bartling, Chandler, AZ (US); Igor Wojewoda, Tempe, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 554 days.

(21) Appl. No.: 12/748,881

(22) Filed: Mar. 29, 2010

(65) Prior Publication Data

US 2010/0259179 A1 Oct. 14, 2010

Related U.S. Application Data

(60) Provisional application No. 61/168,651, filed on Apr. 13, 2009.

(51) Int. Cl.
*H05B 37/02* (2006.01)

(52) U.S. Cl.
USPC ..... 315/291; 315/287; 315/308

(58) Field of Classification Search
USPC ..... 315/209 R, 330, 291, 307–308, 315/224–225, 287
See application file for complete search history.

(56) References Cited

U.S. PATENT DOCUMENTS

| | | | | |
|---|---|---|---|---|
| 4,942,422 | A * | 7/1990 | Mashiko et al. | 355/28 |
| 5,420,481 | A * | 5/1995 | McCanney | 315/291 |
| 6,750,842 | B2 * | 6/2004 | Yu | 345/102 |
| 6,963,178 | B1 * | 11/2005 | Lev et al. | 315/307 |
| 7,663,324 | B2 * | 2/2010 | Tran et al. | 315/291 |
| 8,164,367 | B1 * | 4/2012 | Bal et al. | 327/157 |
| 2005/0156534 | A1 | 7/2005 | Oh | 315/247 |
| 2005/0162144 | A1 * | 7/2005 | Kernahan | 323/300 |
| 2005/0275355 | A1 | 12/2005 | Samuelsson | 315/307 |
| 2006/0049959 | A1 * | 3/2006 | Sanchez | 340/855.3 |
| 2008/0054825 | A1 * | 3/2008 | Gulsen et al. | 315/307 |
| 2010/0079078 | A1 | 4/2010 | Gulsen et al. | 315/247 |

FOREIGN PATENT DOCUMENTS

WO 2008/096306 A1 8/2008 ..... H05B 41/392

OTHER PUBLICATIONS

International PCT Search Report and Written Opinion, PCT/US2010/030729, 16 pages, Jul. 15, 2010.
"ATtiny15L datasheet", Atmel Corporation, retrieved from Internet: www.atmel.com/dyn/resources/prod_documents/doc1187.pdf, 86 pages, XP002589615, Sep. 2007.

* cited by examiner

*Primary Examiner* — Douglas W Owens
*Assistant Examiner* — Henry Luong
(74) *Attorney, Agent, or Firm* — King & Spalding L.L.P.

(57) ABSTRACT

A fluorescent lamp light intensity dimming control generates a pulse width modulation (PWM) signal at about a fifty percent duty cycle and has very fine frequency change granularity to allow precise and smooth light dimming capabilities. Intermediate PWM signal frequencies between the frequencies that are normally generated from values in a period register of the PWM generator are provided with a variable frequency clock source to the PWM generator. Selection of each frequency from the plurality of frequencies available from the variable frequency clock source may be determined from a value stored in a variable frequency clock register. A microcontroller may be used to select appropriate frequencies for dimming control of the fluorescent lamp from the variable frequency clock source, and the period and duty cycle values used in generating the PWM signal at about a fifty percent duty cycle.

29 Claims, 5 Drawing Sheets

HIGH RESOLUTION PULSE WIDTH MODULATION (PWM) FREQUENCY CONTROL USING A TUNABLE OSCILLATOR

This application claims priority to commonly owned U.S. Provisional Patent Applications Ser. No. 61/168,651; filed Apr. 13, 2009; entitled "High Resolution Pulse Width Modulation (PWM) Frequency Control Using a Tunable Oscillator," by Stephen Bowling, James Baffling and Igor Wojewoda; and is hereby incorporated by reference herein for all purposes.

TECHNICAL FIELD

The present disclosure relates to fluorescent lamp electronic dimming devices, and, more particularly, to an electronic dimming device using a pulse width modulation (PWM) generator receiving a clock frequency from a very high resolution tunable oscillator.

BACKGROUND

With the motivation to switch to more efficient methods of generating light, such as use of fluorescent lamps, a need exists to provide features such as dimming at an economical cost. A typical resonant circuit fluorescent lighting ballast and fluorescent lamp are shown in FIG. 1. Operation may be understood by representing this circuit as two equivalent resistor-inductor-capacitor (RLC) circuits. The first equivalent circuit, shown in FIG. 2, is series resonant at a particular frequency, selection of which depends on the choice of components and control resolution of an oscillator circuit. For example, a frequency may be selected at about 70 kHz which will be the series resonance of the inductor 110 and the filament capacitor 116 (Cf). The second equivalent circuit is shown in FIG. 3. Note that in both equivalent circuits the capacitor 114 (C) has been replaced by a short circuit (zero resistance). The function of the capacitor 114 is to perform DC blocking (allowing only AC signals through the circuit) and is chosen to have a high value of capacitance for this purpose. It is modeled to be a short (low impedance connection at the AC signal frequencies) in these equivalent circuits.

When the fluorescent lamp 112 is off, the ballast is first driven at frequency, $F_{High}$. This frequency is chosen to be above the resonant frequency point of the RLC circuit, and is design specific, but may be for example purposes about 100 kHz. At this frequency, FIG. 2 best represents the lamp's equivalent circuit since the lamp gas has not yet ionized. The frequency response of the circuit with respect to the current is shown in FIG. 4. The purpose here is to run current through the filaments of the lamp, this is typically referred to as the 'Preheat' interval (1). When the filaments are warm enough to ionize the surrounding lamp gas, the drive frequency is lowered. This causes the RLC circuit to be swept near its resonant frequency, causing an increase in the voltage across the lamp. An arc will occur in the lamp at its 'strike' voltage (2) and the arc will ignite (ionize) the gas.

Lamp 'ignition' means that the gas is now ionized enough to conduct an electric current. The lamp 112 is now said to be on (producing visible light). At this point, FIG. 3 best describes the behavior of the lamp ballast circuit. Note that the lamp 112 now behaves as an L in series with a parallel R and Cf. The R in this case is the electrical resistance of the ionized gas in the lamp 112 and Cf is the filament capacitance 716. Once the lamp 112 is ignited the voltage stays fairly constant, but the light intensity from the fluorescent lamp(s) will vary as frequency thereto changes. A typical useful dimming range may occur from about 50 KHz to about 100 KHz, shown as the second plot curve (3) of FIG. 4. As more current flows through the fluorescent lamp (higher voltage across the filaments of the lamp 112, the greater the light intensity. The current flowing through the lamp 112 can be controlled by adjusting the frequency of an input signal to the lamp 112. The lamp 112 and reactive circuit may be driven by a pair of power transistors 106 and 108 that are typically external to a control device 120. All of the other elements within the box are typically part of the control device 120. The power transistors 106 and 108 are driven in a complementary fashion so that the top transistor 106 is on for part of a period, T, and the bottom transistor 108 is on for the remainder of the period. A dead time interval is used between the on times so that both power transistors 106 and 108 are never conducting at the same time (see FIG. 8).

To control the fluorescent lamp, the dead time unit must receive a variable frequency signal with a duty cycle of about 50%. A signal may be provided in a microcontroller based application by a pulse width modulation (PWM) generator in combination with a clock, e.g., resistor capacitor (RC) oscillator. The PWM generator has the ability to generate digital signals with controllable variable frequency and duty cycle. The frequency of the PWM signal is adjusted by changing the value of a PWM period register, while the duty cycle is maintained at substantially fifty (50) percent by changing the value of a PWM duty register (see FIG. 6).

Florescent light ballast manufacturers require ultra high frequency resolution to provide smooth and accurate dimming control of the fluorescent lamps. The frequency step resolution of the PWM generator is a function of the input clock frequency thereto and the desired lamp excitation frequency. However, in typical PWM generator applications, the PWM period register adjustment is not capable of producing small enough frequency steps for precise control of the lamp current (light intensity). In order to provide such resolution, for example at 100 kHz, it would require a pulse width modulation (PWM) generator, used for controlling the fluorescent lamp dimming, to be driven with a clock frequency in excess of 50 MHz.

SUMMARY

What is needed is a way to improve dimming control of fluorescent lamps. Accordingly, by supplying a tunable oscillator as a clock input to a pulse width modulation (PWM) generator, a very high resolution frequency PWM generator can be achieved without the necessity for an ultra-high frequency oscillator. By using an oscillator that can be tuned in small frequency steps, the same results can be achieved with an input clock frequency of about, for example but not limited to, 16 MHz instead of having to resort to a power consuming ultra-high frequency oscillator, e.g., in excess of 50 MHz. Use of a much lower frequency clock oscillator also has the advantage of lower generated electromagnetic interference (EMI), lower power consumption, and lower device fabrication and process costs.

According to the teachings of this disclosure, a tuning register, OSCTUN, in combination with a RC oscillator may be used to create a precision variable frequency clock source that supplies a precision tunable clock frequency to a PWM generator that may be used in a fluorescent lamp dimming device for precision control of light intensity of a fluorescent lamp(s).

The OSCTUN register can be used in these cases to provide fine frequency adjustment of the RC oscillator, which is the PWM generator clock source. For each value of the PWM period register, the OSCTUN register can be modified to provide one or more intermediate frequency adjustment steps. The RC oscillator output may optionally be connected to a PLL to increase the frequency of the PWM generator clock.

According to a specific example embodiment of this disclosure, a dimmable fluorescent lamp system having an electronic lighting ballast using pulse width modulation (PWM) to control the amount of light produced by a fluorescent lamp comprises: a clock oscillator capable of generating any one of a plurality of clock frequencies; a pulse width modulation (PWM) generator for generating a PWM signal, wherein the PWM generator receives a clock signal from the clock oscillator at the selected one of the plurality of clock frequencies; a circuit for converting the PWM signal to high and low drive signals; a first power switch controlled by the high drive signal; a second power switch controlled by the low drive signal; an inductor coupled to the first and second power switches, wherein the first power switch couples the inductor to a supply voltage, the second power switch couples the inductor to a supply voltage common, and the first and second power switches decouple the inductor from the supply voltage and supply voltage common, respectively; a direct current (DC) blocking capacitor coupled to the supply voltage common; a fluorescent lamp having first and second filaments, wherein the first filament is coupled to the inductor and the second filament is coupled to the DC blocking capacitor; and a filament capacitor coupling together the first and second filaments of the fluorescent lamp; wherein coarse frequency steps of the PWM signal are provided by the PWM generator and fine frequency steps of the PWM signal are provided by selecting appropriate frequencies from the plurality of clock frequencies.

According to another specific example embodiment of this disclosure, a method for controlling dimmable electronic lighting ballasts using pulse width modulation (PWM) comprises the steps of: generating a clock signal having a frequency selected from a plurality of clock frequencies; and generating a pulse width modulation (PWM) signal having any one of a plurality of PWM signal frequencies, wherein the PWM signal is derived from the clock signal; wherein the PWM signal has coarse frequency steps are provided by period and duty cycle values of the PWM generator, and fine frequency steps are provided by selecting appropriate frequencies from the plurality of clock frequencies.

According to yet another specific example embodiment of this disclosure, a digital device for supplying a variable frequency pulse width modulation (PWM) signal for controlling light brightness of a fluorescent lamp comprises: a clock oscillator capable of generating any one of a plurality of clock frequencies; a pulse width modulation (PWM) generator for generating a PWM signal, wherein the PWM generator receives a clock signal from the clock oscillator at the selected one of the plurality of clock frequencies; and a circuit for converting the PWM signal to high and low drive signals; wherein coarse frequency steps of the PWM signal are provided by the PWM generator and fine frequency steps of the PWM signal are provided by selecting appropriate frequencies from the plurality of clock frequencies. According to another embodiment, the fine frequency steps are less than or equal to about 60 Hz.

BRIEF DESCRIPTION OF THE DRAWINGS

A more complete understanding of the present disclosure thereof may be acquired by referring to the following description taken in conjunction with the accompanying drawings wherein.

Figure 1:
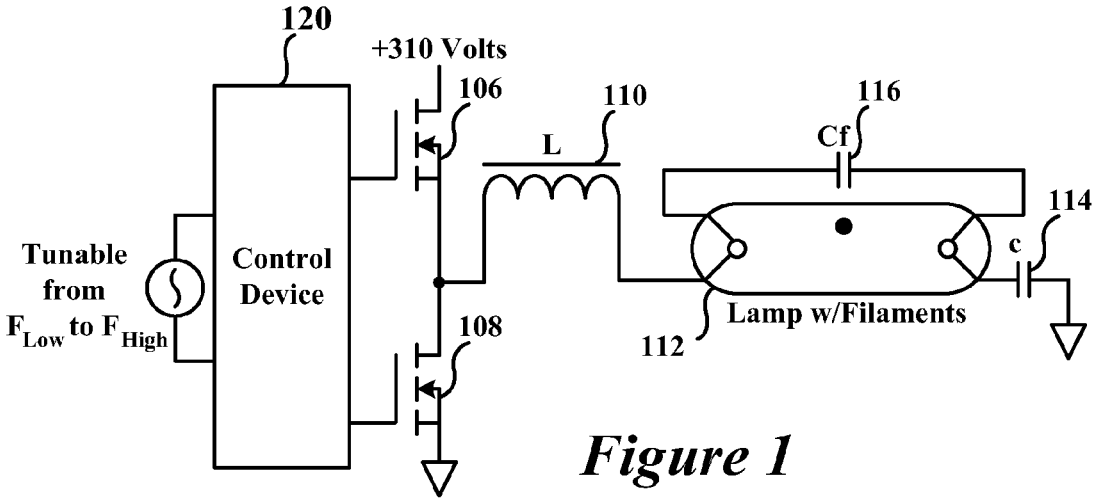
FIG. 1 illustrates a schematic diagram of a typical resonant circuit fluorescent dimmable lighting ballast and fluorescent lamp circuit.
Figure 2:
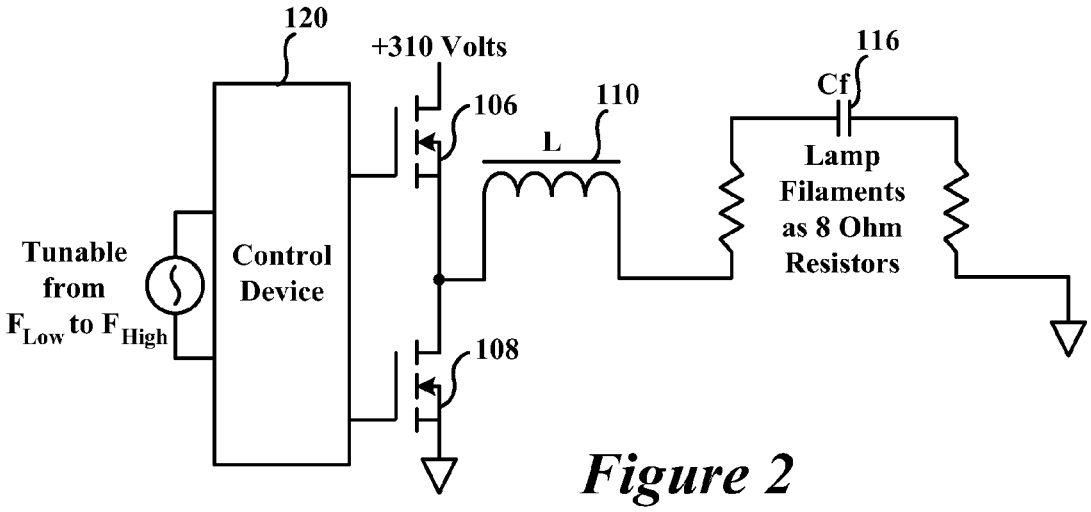
FIG. 2 illustrates a schematic diagram of an equivalent circuit of FIG. 1 wherein the fluorescent lamp gas has not yet ionized.
Figure 3:
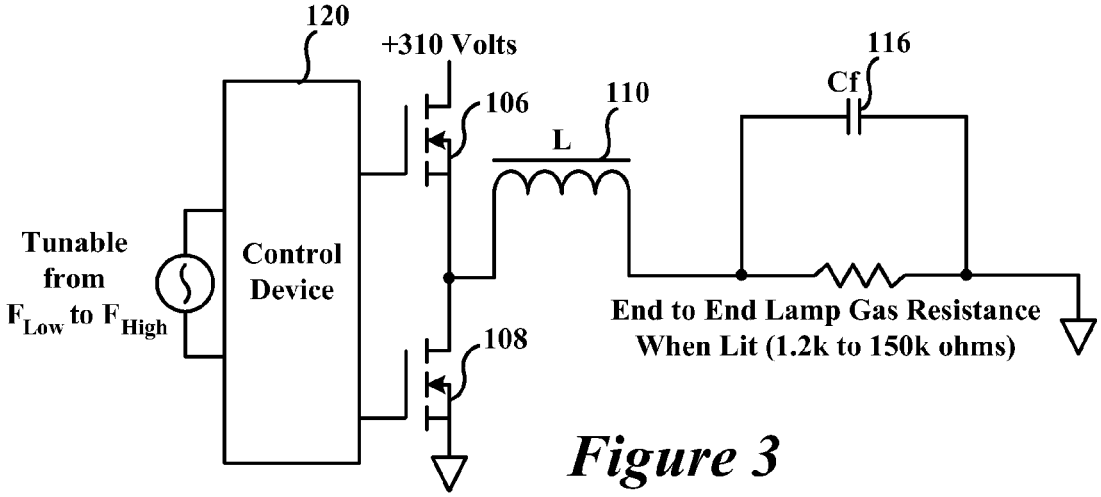
FIG. 3 illustrates a schematic diagram of an equivalent circuit of FIG. 1 wherein the fluorescent lamp gas has ionized and current is flowing therethrough.
Figure 4:
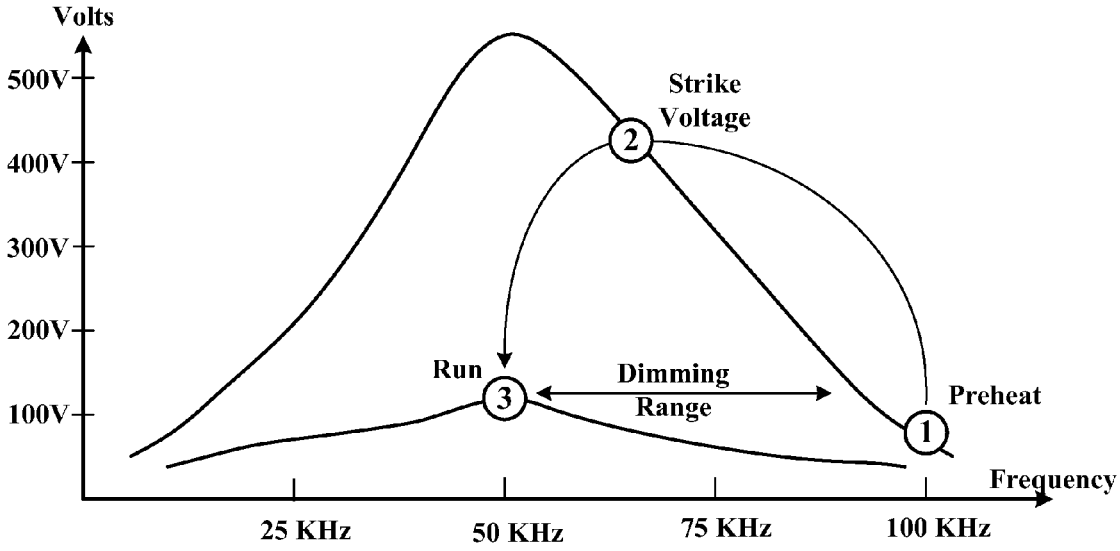
FIG. 4 illustrates a schematic diagram of frequency versus voltage responses of a fluorescent lamp circuit before and after gas ionization.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawing, the details of specific example embodiments are schematically illustrated. Like elements in the drawings will be represented by like numbers, and similar elements will be represented by like numbers with a different lower case letter suffix.

Figure 5:
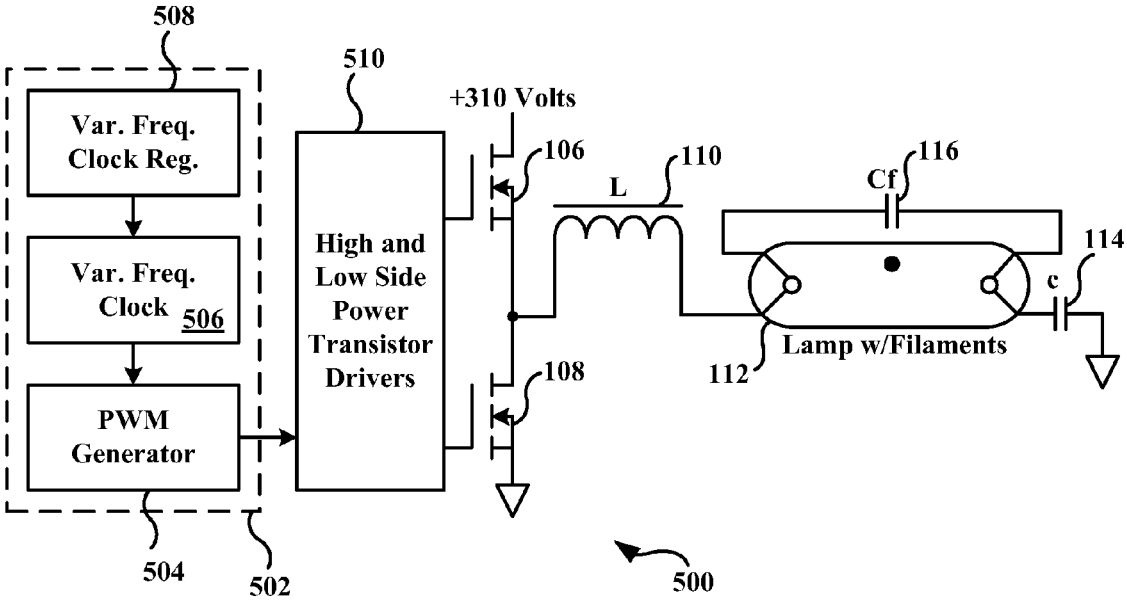
FIG. 5 illustrates a schematic block diagram of pulse width modulation (PWM) fluorescent lamp dimming circuit, according to a specific example embodiment of this disclosure.
Figure 7:
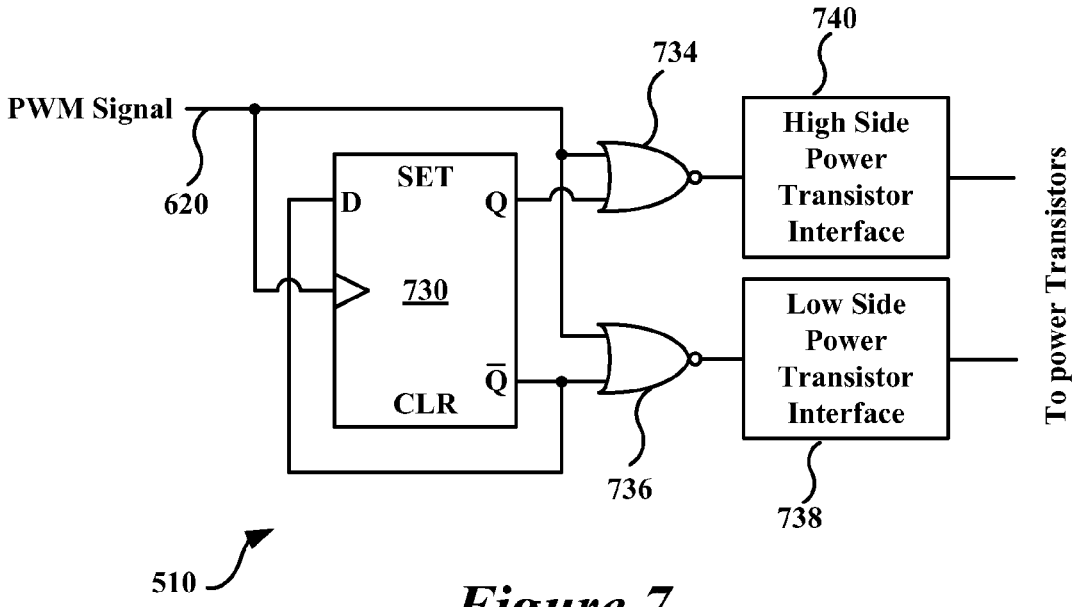
FIG. 7 illustrates a schematic block diagram of a typical circuit for converting a square wave into two drive signals to turn on and off the power switching transistors shown in FIG. 5.

According to teachings of this disclosure, a pulse width modulation technique for dimming a fluorescent lamp may be implemented by using an integrated circuit digital device, e.g., microcontroller integrated circuit. Referring now to FIG. 5, depicted is a schematic block diagram of pulse width modulation (PWM) fluorescent lamp dimming circuit, according to a specific example embodiment of this disclosure. The PWM fluorescent lamp dimming circuit, generally represented by the numeral 500, may comprise a digital device 502, high and low side drivers 510, a high-side power switching transistor 106, a low-side power switching transistor 108, an inductor 110, a fluorescent lamp 112, a filament capacitor 116, and a DC blocking capacitor 114. The power switching transistor drivers 510 may be used to translate the low output voltages from the digital device 502 to the high voltage levels required to operate the high side power switching transistor 106 and the low side power switching transistor 108. The digital device 502 may be used to switch the high-side driver ON or OFF, and the low-side drive OFF or On, respectively, of the power switching transistor drivers 510. When the high-side drive is ON the high-side power switching transistor 106 allows current to flow through the resonant RLC fluorescent lamp circuit (inductor 110, fluorescent lamp 112 and DC blocking capacitor 114) in one direction, and when the low-side drive is ON the low-side power switching transistor 108 allows current to flow through the resonant RLC fluorescent lamp circuit (inductor 110, fluorescent lamp 112 and DC blocking capacitor 114) in the other direction. The high-side power switching transistor 106 and the low-side power switching transistor 108 cannot be both ON at the same time. Also a dead band is desirable, e.g., the high-side power switching transistor 106 and the low-side power switching transistor 108 are both OFF (see FIG. 8). This may be easily accomplished with hardware functions (e.g., firmware and processor, programmable logic or gate array, etc.) running in the digital device 502 or by a hardware circuit such as shown in FIG. 7. The digital device 502 may synthesize an alternating current (AC) signal by alternatively turning on the high-side and low-side outputs of the power switching transistor drivers 510. By carefully controlling the time duration of the high-side and low-side outputs of the power switching transistor drivers 510, AC power at selected frequencies is synthesized. The digital device 502 may comprise a microprocessor, a microcontroller, an application specific integrated circuit (ASIC), a programmable logic array (PLA), etc. The power switching transistors may be, for example but are not limited to, metal oxide field effect transistors (MOSFETs), insulated gate bipolar transistors (IGBTs), etc.

The AC power at the specific frequencies generate an AC line voltage that is applied to the combination of the inductor 110, fluorescent lamp 112 and the DC blocking capacitor 114. The specific frequencies are selectable for initiating lamp gas ionization and controlling the current through the ionized gas, thereby controlling light intensity from the fluorescent lamp 112.

The digital device 502 comprises a pulse width modulation (PWM) generator 504, a variable frequency clock 506 used as the timing signal for the PWM generator 504, and a variable frequency clock register 508 for storing digital representations of "veneer frequency" offsets of the variable frequency clock 506. The variable frequency clock 506 enables being able to use finer frequency granularity when selecting a power drive frequency to be generated by the PWM generator 504, as more fully described herein. The variable frequency clock 506 may comprise an resistor-capacitor (RC) oscillator or any other type of oscillator that may be tuned over a small range of frequencies.

Figure 6:
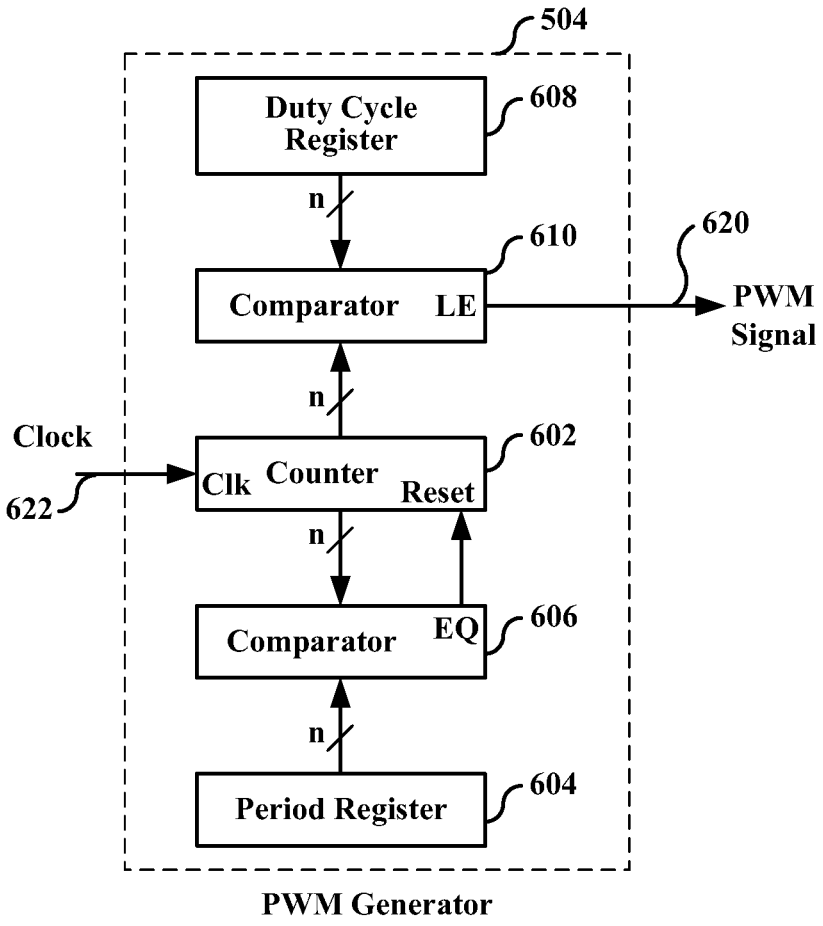
FIG. 6 illustrates a schematic block diagram of a PWM generator that may be used in the PWM fluorescent lamp dimming circuit shown in FIG. 5.

Referring to FIG. 6, depicted is a schematic block diagram of a PWM generator that may be used in the PWM fluorescent lamp dimming circuit shown in FIG. 5. Typically a timer/counter 602 counts up from zero until it reaches a value specified by a period register 604 as determined by a comparator 606. The counter 602 is incremented each time a clock signal 622 is received at the clock input of the counter 602. The period register 604 contains a user specified value which represents the maximum counter value that determines the PWM period. When the timer/counter 602 matches the value in the period register 604, the timer/counter 602 is cleared by a reset signal from the comparator 606 and the cycle repeats. A duty cycle register 608 stores the user specified duty cycle value. The count value from the counter 602 is compared to the duty cycle value in the duty cycle register 608 with a comparator 610. The comparator 610 asserts a PWM output signal 620 (driven high) whenever the timer/counter 602 value is less than or equal to the duty cycle value stored in the duty cycle register 608, and when the timer/counter value 602 is greater than the duty cycle value stored in the duty cycle register 608, the PWM output signal 620 is de-asserted (driven low).

By selecting appropriate duty cycle and period values in combination with the frequencies of the clock signal 622, a substantially fifty (50) percent duty cycle square wave over a wide range of frequencies can be generated for dimming control of the light intensity (brightness) from the fluorescent lamp 112. The clock signal 622 may be varied over a narrow range of frequencies so as to fine tune the PWM signal frequency between what is normally available between changes to the period value, as more fully described herein. This enables finer granularity of the PWM frequency so that there is more precise and smoother control when dimming the fluorescent lamp light intensity (brightness).

The PWM frequency is the clock signal 622 frequency divided by the value in the period register. A corresponding value is loaded into the duty cycle register so that the PWM signal 620 has substantially a 50 percent duty cycle, e.g., on for about half of a PWM period and off for the other half of the PWM period. The PWM period is the reciprocal of the PWM frequency. Thus, the frequency of the PWM signal 620 is determined by the frequency of the clock signal 622 divided by the "period count value" stored in the period register 604. For example, using a clock frequency of 16 MHz and a period count value of 160 will produce a PWM signal 620 at a frequency of 100 KHz. Table I below shows some of the PWM signal frequencies and associated period count values at a clock frequency of 16 MHz. Not every period count value is shown in Table I, but one having ordinary skill in the art of digital circuits in PWM generation and the benefit of this disclosure would readily understand that the period count value can be incremented or decremented by one (1).

According to the teachings of this disclosure, when the clock frequency is offset plus or minus in frequency, a finer frequency granularity control is achieved as shown in Table II below. The variable frequency clock 506 (FIG. 5) can be trimmed plus or minus in frequency through the variable frequency clock register 508. The digital device 502 is programmed to load period values into the period register 604 so as to generate a PWM signal 620 at frequencies determined by these period values and the frequency of the clock signal 622. The digital device 502 is also programmed to control the frequency of the variable frequency clock 506 through the variable frequency clock register 508 so as to increase the frequency granularity of the resulting PWM signal 620. This feature allows more precise and even control in dimming of the fluorescent lamp light intensity. The digital device 502 also is programmed to load appropriate duty' cycle values into the duty cycle register 608 so as to maintain the duty cycle of the PWM signal at substantially fifty percent.

TABLE I

| Clock - 16 MHz PWM Freq. (Hz) | Period Register |
|---|---|
| 100,000 | 160 |
| 88,888 | 180 |
| 80,000 | 200 |
| 76,190 | 210 |
| 74,419 | 215 |
| 74,074 | 216 |
| 73,733 | 217 |
| 73,394 | 218 |
| 73,059 | 219 |

TABLE I-continued

| Clock - 16 MHz PWM Freq. (Hz) | Period Register |
|---|---|
| 72,727 | 220 |
| 71,111 | 225 |
| 69,565 | 230 |
| 66,666 | 240 |
| 61,538 | 260 |
| 57,143 | 280 |
| 53,333 | 300 |
| 50,000 | 320 |

When the frequency of the clock signal 622 is fixed at 16,000,000 Hertz (Hz), the frequency steps of the PWM signal 620 can only change at about 340 to 345 Hz per step (period register value). These frequency steps may be too coarse for smooth dimming control of fluorescent lamp light intensity (brightness).

TABLE II

| Clock Osc. @ (Hz) | Osc. Tune Reg. @ | Period Reg. @ 217 | Period Reg. @ 216 | Period Reg. @ 215 |
|---|---|---|---|---|
| 16,031,309 | +3 | 73,877 Hz | 74,219 Hz | 74,564 Hz |
| 16,020,893 | +2 | 73,829 Hz | 74,170 Hz | 74,515 Hz |
| 16,010,477 | +1 | 73,781 Hz | 74,123 Hz | 74,467 Hz |
| 16,000,000 | 0 | 73,733 Hz | 74,074 Hz | 74,419 Hz |
| 15,988,536 | −1 | 73,680 Hz | 74,021 Hz | 74,365 Hz |
| 15,978,168 | −2 | 73,632 Hz | 73,973 Hz | 74,317 Hz |
| 15,967,800 | −3 | 73,584 Hz | 73,925 Hz | 74,269 Hz |

When the clock frequency can be set to any one of a plurality of frequencies as indicated in Table II above, then the frequency steps available from the PWM signal 620 are much finer in granularity and may change at about 48 Hz per step. This size frequency step change allows very smooth dimming control of fluorescent lamp light intensity according to the teachings of this disclosure. Modifying the tunable oscillator for even finer adjustment steps can further increase resolution without the need for high PWM frequencies. Therefore, it is contemplated and within the scope of this disclosure that other and further frequency step change sizes may be used according to the teachings of this disclosure. A range of clock frequencies are also contemplated herein, for example, in Table II above clock frequencies are shown to vary a little over plus or minus two (2) percent. Depending upon the number of bits of the PWM generator allowing a certain range of frequency step changes, the clock frequencies may be varied, but is not limited to, from about one (1) percent to about five (5) percent of the center frequency of the clock oscillator.

Figure 8:
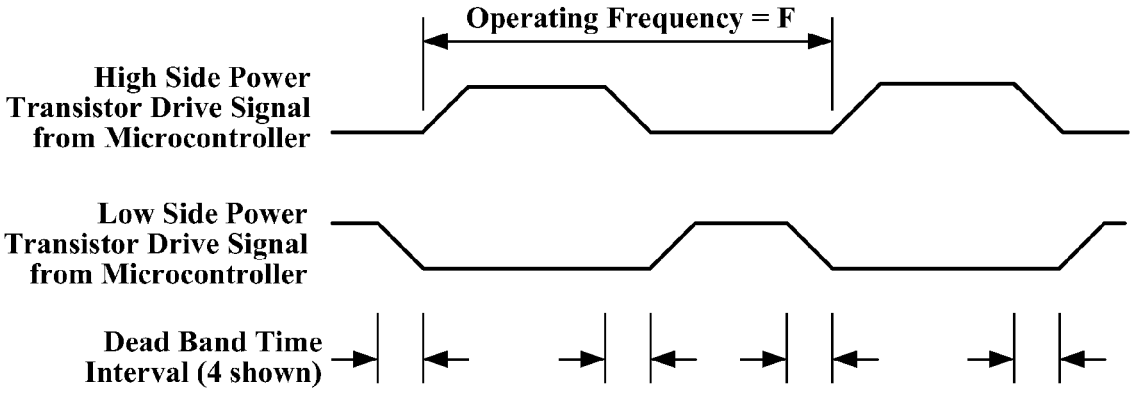
FIG. 8 illustrates a schematic waveform timing diagram of the output waveforms from the circuit shown in FIG. 7.

Referring to FIG. 7, depicted is a schematic block diagram of a typical circuit for converting a square wave into two drive signals for turning on and off the power switching transistors 106 and 108 shown in FIG. 5. A flip-flop 730, and NOR gates 734 and 736 produce a high and a low output, respectively, that are mutually exclusive, i.e., when one is on and the other is off. A high-side power switching transistor interface 740 drives the gate of the high-side power switching transistor 106, and a low-side power switching transistor interface 738 drives the gate of the low-side power switching transistor 108. A typical waveform from the power switching transistor drivers 510 is shown in FIG. 8. It is contemplated and within the scope of this disclosure that many other logic circuit designs may be used for converting a PWM square wave signal into two or more drive signals as described herein, and that one having ordinary skill in the art of digital circuit design and the benefit of this disclosure could easy design such circuits. For example, some fluorescent lamp applications use a full bridge of four switches requiring four drive signals for control thereof.

Figure 9:
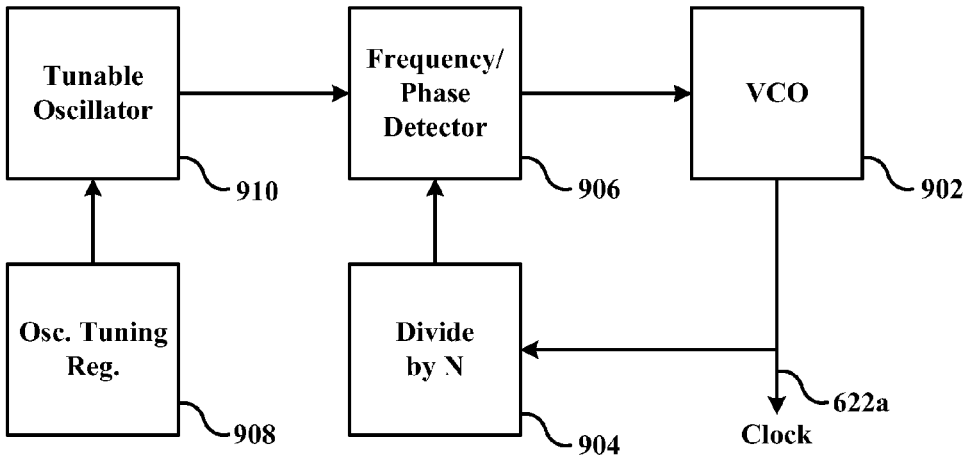
FIG. 9 illustrates a schematic block diagram of a tunable clock oscillator using a phase-locked-loop (PLL), according to another specific example embodiment of this disclosure.

Referring to FIG. 9, depicted is a schematic block diagram of a tunable clock oscillator using a phase-locked-loop (PLL), according to another specific example embodiment of this disclosure. The PLL comprises a voltage controlled oscillator (VCO) 902, an N-frequency divider 904, a frequency/phase detector 906, a tunable reference oscillator 910, and an oscillator tuning register 908. The PLL may be used in generating a clock signal 622*a* for the PWM generator 504, and has the advantage that a higher frequency clock signal 622*a* may be generated from the lower frequency tunable reference oscillator 910. The reference oscillator 910 may be set to any one of a plurality of frequencies and the frequency selection is controlled from the oscillator tuning register 908. Some applications may not require the use of a tunable clock oscillator using a PLL, and it is contemplated in this disclosure that any type of clock oscillator may be used.

Figure 10:
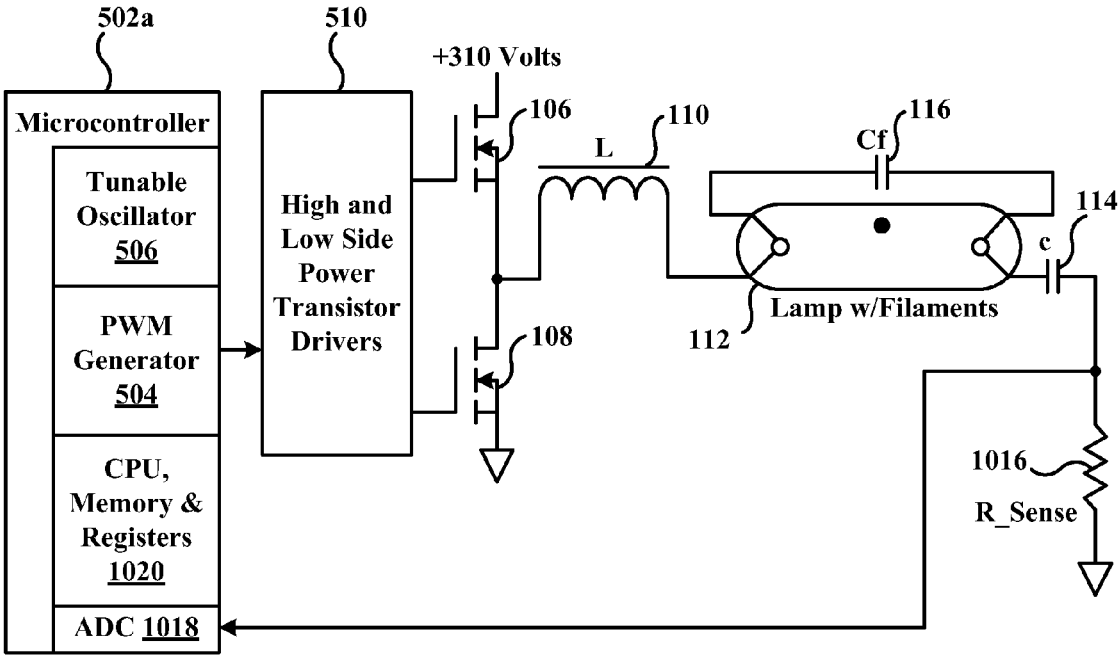
FIG. 10 illustrates a schematic diagram of the fluorescent lamp circuit of FIG. 5 further comprising a current sense resistor, according to still another specific example embodiment of this disclosure.

FIG. 10 illustrates a schematic diagram of the fluorescent lamp circuit of FIG. 5 further comprising a current sense resistor, according to still another specific example embodiment of this disclosure. When a sense resistor 1016 is added to the circuit of FIG. 5, feedback control of the apparent brightness of the fluorescent lamp(s) may be implemented by measuring the current through the sense resistor 1016. The current through the sense resistor 1016 is substantially the same as the current through the lamp 112. The current through the sense resistor 1016 will produce a voltage across the sense resistor 1016 that is proportional to the lamp current. This voltage may be fed into an analog-to-digital converter (ADC) of the digital device 502*a*.

There are a number of feedback control techniques that may be implemented to stabilize the operation of the fluorescent lamp brightness. A common technique known in the literature as PID control (proportional-integral-differential) may be implemented in software to maximize stability of the fluorescent lamp brightness. A PID control loop may use this analog input representing fluorescent lamp brightness to adjust the lamp dimming circuit so as to deliver a consistent perceived lamp brightness level.

That is, if the user of the lamp adjusts the lamp control to demand a 70 percent brightness level, the software program running on the digital device 502*a* may consider this as the demanded brightness level. A check of the current through the fluorescent lamp 112 will indicate the present apparent brightness of the fluorescent lamp 112. If the values don't agree, the dimming of the fluorescent lamp 112 may be adjusted up or down to increase or decrease the current through the fluorescent lamp 112. As the fluorescent lamp 112 increases or decreases in temperature because of its new brightness setting, the brightness may drift. The feedback control via the microcontroller's software program will maintain the demanded brightness regardless of temperature transitions (e.g., drift or transients) in the fluorescent lamp 112.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A dimmable fluorescent lamp system having an electronic lighting ballast using pulse width modulation (PWM) to control the amount of light produced by a fluorescent lamp, said system comprising:

a clock oscillator capable of generating any one of a plurality of clock frequencies;

a pulse width modulation (PWM) generator for generating a PWM signal, wherein the PWM generator receives a clock signal from the clock oscillator at the selected one of the plurality of clock frequencies;

a circuit for converting the PWM signal to high and low drive signals;

a first power switch controlled by the high drive signal;

a second power switch controlled by the low drive signal;

an inductor coupled to the first and second power switches, wherein the first power switch couples the inductor to a supply voltage, the second power switch couples the inductor to a supply voltage common, and the first and second power switches decouple the inductor from the supply voltage and supply voltage common, respectively;

a direct current (DC) blocking capacitor coupled to the supply voltage common;

a fluorescent lamp having first and second filaments, wherein the first filament is coupled to the inductor and the second filament is coupled to the DC blocking capacitor; and a filament capacitor coupling together the first and second filaments of the fluorescent lamp;

wherein to control the amount of light produced by the fluorescent lamp, coarse dimming steps are provided by the PWM generator and fine dimming steps are provided by selecting appropriate frequencies from the plurality of clock frequencies, wherein the selected one of the plurality of clock frequencies is within a range that allows current to flow through the fluorescent lamp to generate light.

2. The system according to claim 1, wherein the first and second power switches are first and second power switching transistors, respectively.

3. The system according to claim 2, wherein the first and second power switching transistors are metal oxide semiconductor field effect transistors (MOSFETs).

4. The system according to claim 2, wherein the first and second power switching transistors are insulated gate bipolar transistors (IGBTs).

5. The system according to claim 1, wherein an integrated circuit digital device comprises the clock oscillator and the PWM generator and the digital device further comprises a clock register coupled to the clock oscillator and storing which one of the plurality of clock frequencies are generated by the clock oscillator for the coarse dimming steps, and period and duty cycle registers for the fine dimming steps of the PWM generator.

6. The system according to claim 5, wherein the digital device is a microcontroller.

7. The system according to claim 5, wherein the digital device is selected from the group consisting of a microprocessor, an application specific integrated circuit (ASIC), and a programmable logic array (PLA).

8. The system according to claim 5, further comprising a fluorescent lamp current measurement resistor coupled between the DC blocking capacitor and the supply voltage common, wherein the fluorescent lamp current measurement resistor is used for measuring the fluorescent lamp current.

9. The system according to claim 8, wherein a voltage across the fluorescent lamp current measurement resistor is coupled to an analog input of the digital device, whereby the digital device uses the voltage to maintain a constant light intensity from the fluorescent lamp.

10. The system according to claim 5, wherein the digital device is controlled with a digital processor and a firmware program.

11. The system according to claim 1, wherein the clock oscillator uses a phase-locked-loop (PLL) for generating higher clock frequencies.

12. The system according to claim 1, wherein the plurality of clock frequencies comprises plus or minus from about one (1) percent to about five (5) percent of a center frequency of the clock oscillator.

13. The system according to claim 12, wherein the center frequency is about 16 MHz.

14. The system according to claim 1, wherein the PWM signal is at a frequency that can be varied from about 50 KHz to about 100 KHz.

15. The system according to claim 1, wherein the fine dimming steps are less than or equal to about 60 Hz.

16. The system according to claim 1, further comprising third and fourth power switches configured as a full bridge power control circuit.

17. A method for controlling dimmable electronic lighting ballasts using pulse width modulation (PWM), said method comprising the steps of:

generating a clock signal with an oscillator having a frequency selected from a plurality of clock frequencies; and generating a pulse width modulation (PWM) signal with a PWM generator having any one of a plurality of PWM signal frequencies, wherein the PWM signal is derived from the clock signal;

wherein to control the amount of light produced by the fluorescent lamp, the PWM signal has coarse dimming steps provided by period and duty cycle values of the PWM generator, and fine dimming steps provided by selecting appropriate frequencies from the plurality of clock frequencies, wherein the selected one of the plurality of clock frequencies is within a range that allows current to flow through the fluorescent lamp to generate light.

18. The method according to claim 17, wherein the PWM signal frequency is variable between about 50 KHz to about 100 KHz.

19. The method according to claim 17, wherein the fine dimming steps are less than or equal to about 60 Hz.

20. The method according to claim 17, wherein the clock signal is generated with a phase-locked-loop (PLL) oscillator.

21. The method according to claim 17, wherein the plurality of clock frequencies comprises plus or minus from about one (1) percent to about five (5) percent of a center frequency of the clock signal.

22. The method according to claim 21, wherein the center frequency is about 16 MHz.

23. A digital device for supplying a variable frequency pulse width modulation (PWM) signal for controlling light brightness of a fluorescent lamp, comprising:

a clock oscillator capable of generating any one of a plurality of clock frequencies;

a pulse width modulation (PWM) generator for generating a PWM signal, wherein the PWM generator receives a clock signal from the clock oscillator at the selected one of the plurality of clock frequencies; and a circuit for converting the PWM signal to high and low drive signals;

wherein to control the amount of light produced by the fluorescent lamp, coarse dimming steps are provided by the PWM generator and fine dimming steps are provided by selecting appropriate frequencies from the plurality of clock frequencies, wherein the selected one of the plurality of clock frequencies is within a range that allows current to flow through the fluorescent lamp to generate light.

24. The digital device according to claim 23, further comprising at least one register for storing which one of the plurality of clock frequencies is generated by the clock oscillator for the fine dimming steps, and period and duty cycle registers for the coarse dimming steps of the PWM generator.

25. The digital device according to claim 23, wherein the PWM signal frequency is variable between about 50 KHz to about 100 KHz.

26. The digital device according to claim 23, wherein the fine dimming steps are less than or equal to about 60 Hz.

27. The digital device according to claim 23, wherein the clock oscillator is a phase-locked-loop (PLL) oscillator.

28. The digital device according to claim 23, wherein the plurality of clock frequencies comprises plus or minus from about one (1) percent to about five (5) percent of a center frequency of the clock oscillator.

29. The system according to claim 28, wherein the center frequency is about 16 MHz.

* * * * *